United States Patent [19]

Christensen et al.

[11] Patent Number: 4,959,795

[45] Date of Patent: Sep. 25, 1990

[54] INSERTION MACHINE WITH DISTRIBUTED CHARGEBACK

[75] Inventors: Dean Christensen, St. Louis, Mo.; David J. Helffrich, Bethlehem, Pa.; Christopher K. Scullion, Catasauqua, Pa.; Edward W. Hindle, Whitehall, Pa.

[73] Assignee: Bell & Howell Company, Chicago, Ill.

[21] Appl. No.: 294,726

[22] Filed: Jan. 9, 1989

Related U.S. Application Data

[63] Continuation-in-part of Ser. No. 6,853, Jan. 27, 1987, Pat. No. 4,797,830, which is a continuation of Ser. No. 818,389, Jan. 13, 1986, Pat. No. 4,639,873, which is a continuation of Ser. No. 576,839, Feb. 3, 1984, abandoned.

[51] Int. Cl.[5] ..... G07B 17/02

[52] U.S. Cl. ..... 364/464.03; 53/154; 270/58; 364/478

[58] Field of Search ..... 53/154, 266 A; 270/54, 270/57, 58; 364/464.02, 464.03, 466, 478

[56] References Cited

U.S. PATENT DOCUMENTS

| | | | |
|---|---|---|---|
| 3,570,840 | 3/1971 | Sather et al. | 270/58 |
| 3,606,728 | 9/1971 | Sather et al. | 270/58 X |
| 4,571,925 | 2/1986 | Adams | 53/266 A X |
| 4,639,873 | 1/1987 | Baggarly et al. | 270/58 X |
| 4,734,865 | 3/1988 | Scullion et al. | 364/478 |
| 4,797,830 | 1/1989 | Baggarly et al. | 53/154 X |
| 4,809,187 | 2/1989 | Adams | 364/466 X |
| 4,817,042 | 3/1989 | Pintsov | 364/478 |
| 4,821,493 | 4/1989 | Pintsov | 53/154 X |
| 4,829,443 | 5/1989 | Pintsov et al. | 53/154 X |

*Primary Examiner*—Parshotam S. Lall
*Assistant Examiner*—Edward R. Cosimano
*Attorney, Agent, or Firm*—Griffin Branigan & Butler

[57] ABSTRACT

In a document insertion machine, third-party advertising documents are fed from downstream insert stations (36, 37, 38, 39). The third party insert stations include an optional insert station (39) from which documents are to be fed only if the additional weight occasioned by the feeding does not cause an increase in the postage for a customer's stuffed envelope. The other third party insert stations (36, 37, 38) are chargeback stations which feed documents regardless of the impact of feeding upon the weight of a customer's stuffed envelope. The insertion machine apportions, among the chargeback stations (36, 37, 38), any increase in postage cost which occurs when the feeding of documents from the chargeback stations causes a customer's stuffed envelope to be classified in a more expensive postage category.

22 Claims, 8 Drawing Sheets

INSERTION MACHINE WITH DISTRIBUTED CHARGEBACK

This is a continuation-in-part application of United States Patent Application Serial Number 07/006,853, filed 27 Jan. 1987, now United States Patent 4,797,830, which is a continuation of United States Patent Application Serial Number 818,389, filed 13 Jan. 1986, now United States Patent 4,639,873, which in turn is a continuation of United States Patent Application Serial Number 576,839, filed 3 Feb. 1984 and now abandoned.

BACKGROUND OF THE INVENTION

1. Field of the Invention.

This invention related to an improved multi-station insertion machine and to a method of operating the same.

2. Prior Art and Other Considerations.

United States Patents 2,325,455 and 3,260,517 relate to multi-station inserters which are presently produced and marketed by the assignee of the present application and well-known in the market as the Phillipsburg inserters. In the insertion machines of these patents, a master control document is withdrawn from a master control document station and moved onto an insert track which has a suitable conveyor means for moving the master control document past a plurality of insertion stations. As the master control document is thusly moved, additional documents from the insertion stations are stacked with the master control document to form a group of related documents or items. The master control document and its insertions are then inserted into a mailing envelope by well-known means.

United States Patent 3,260,517 is particularly directed to an improvement of United States Patent 2,325,455 and related to a device for deriving signals from particular master control documents and using those signals to control the subsequent selective insertion of documents from only selected insertion stations.

Once the control document and its inserts have been inserted into the mailing envelope, a determination must be made regarding the amount of postage to be applied to the envelope. In many environments and operations the determination of the postage amount for each envelope is a complex, or else inexact, endeavor.

As an example of such complexity, in the telephone and credit card industries envelopes are mailed monthly to customers and include such enclosures as one or more sheets comprising a statement of account, informational enclosures, and advertising literature. With respect to informational enclosures, the sender may send certain general interest enclosures to all customers while also enclosing one or more of many special interest enclosures to selected or targeted customers in accordance with the sender's estimation of the pertinence of the enclosure relative to each customer. Therefore, the weight of the envelopes can vary considerably from customer to customer depending on, for example, the number of sheets included in the statement of account and the number of items such as informational enclosures and advertising enclosures which are inserted in a customer's envelope.

The complexity of determining accurate postage was ameliorated with the advent of the apparatus and method taught in United States Patent 4,571,925, INSERTION MACHINE WITH POSTAGE CATEGORIZATION, commonly assigned herewith and incorporated herein by reference. In accordance with the teachings of United States Patent 4,571,925, a data processing system, or computer, operating in conjunction with an insertion machine makes a determination relative to postal allocation for a group of items or inserts in accordance with a projected group weight which is calculated by the data processing system on the basis of the per document weights of documents stored at the insert stations.

While the statement of account and, in some instances, the general interest and special interest informational enclosures, are primary or high priority "required" items for inclusion in a customer's envelope, the advertising literature may be less significant and not deserving of inclusion in the envelope. In fact, the advertising literature is often provided by third party advertisers who contract with the sender to include their third-party advertising documents in piggyback fashion along with the primary documents of the sender.

In such arrangements with third party advertisers, some third party advertisers direct that their third-party advertising documents be included with a customer's group of inserts or items if and only if the additional weight of the third-party advertising documents does not increase the postage amount for the customer's group. Other third-party advertisers, however, prefer that their third-party advertising documents be included along with a customer's group regardless of the impact of inclusion upon the postage amount for the group.

United States Patent 4,734,865, INSERTION MACHINE WITH AUDIT TRAIL AND COMMAND PROTOCOL, commonly assigned herewith and incorporated herein by reference, discloses a "chargeback" insert feed station. Third-party advertising inserts are fed from the chargeback station regardless of whether the weight of the third-party advertising insert increases the total weight of a customer's group sufficienly for the group to be classified in the next greater postage weight category (and thereby incur and additional postage charge). In addition, a count was kept of the number of times that feeding from a chargeback station actually occassioned additional postage charge, so that the additional postage charge could be passed on to the third party advertiser associated with the chargeback station.

In accordance with current practice, when an insertion machine is operated with more than one chargeback station, the chargeback stations are ranked according to priority. In accordance with the ranking, for a given customer a higher priority chargeback station is permitted to feed before a lower priority chargeback station can feed. However, whichever chargeback station pushes the customer's group into a greater postage category is charged for the entire amount of the postage cost increase.

In view of the foregoing, it is an object of the present invention to provide an insertion machine and method of operation thereof which accurately determines the weight of an envelope and equitably apportions postage cost among a plurality of third party advertisers.

An advantage of the present invention is the provision of an insertion machine and method of operation thereof which, by accurate determination of the weight of an envelope and its associated inserts, results in substantial financial savings.

An further advantage of the present invention is the provision of an insertion machine and method of operation thereof which is easily operated for determining the accurate weight of an envelope and its associated contents.

Yet another further advantage of the present invention is the provision of an insertion machine and method of operation thereof which is responsive to diverse criteria for deciding whether third party advertising documents are to be included in a customer's group of items.

SUMMARY

In an insertion machine a first insert station feeds one or more sheets for a customer onto a conveyor. the first document fed from the first insert station functions as a master control document in that an indicia thereon indicates which of the insert station further downstream have inserts which are pertinent to the customer. It is required that documents be fed from certain ones of the selected downstream insert stations, and that the weight of the required inserts and envelope of the customer be summed so that a postage categorization range can be determined.

Third-party advertising documents are fed from one or more of other downstream insert stations. Some of the downstream insert stations from which third-party advertising documents are fed are optional insert stations which feed if and only if the additional weight occasioned by the feeding of the advertising documents would not cause an increase in the postage for the customer's stuffed envelope. Other ones of the downstream insert stations from which third-party advertising documents are fed are chargeback stations which feed regardless of the impact of the feeding upon the weight of a customer's stuffed envelope.

The insertion machine apportions, among the chargeback feed stations any increase in postage cost which occurs when the feeding of items from the chargeback feed stations causes a customer's stuffed envelope to be classified in a more expensive postage category than the that in which the envelope would otherwise be classified. In this regard, if C represents the number of groups of items which, because of the feeding from one or more chargeback station, were classified, in higher postage categories, the cost A(X) apportioned to a chargeback feed station X is related to the expression $$A(X) = \frac{D * C * (S(X) * W(X))}{(S(1) * W(1)) + (S(2) * W(2)) + \ldots + (S(N) * W(N))}$$

wherein

N represents the number of chargeback feed stations included in the machine;

S(X) represents the number of items fed from chargeback feed station X (X =1, 2, ... N);

W(X) represents the per item weight of items held at chargeback feed station X;

D represents the incremental cost occasioned by an increase from a lower to a higher postage classification.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
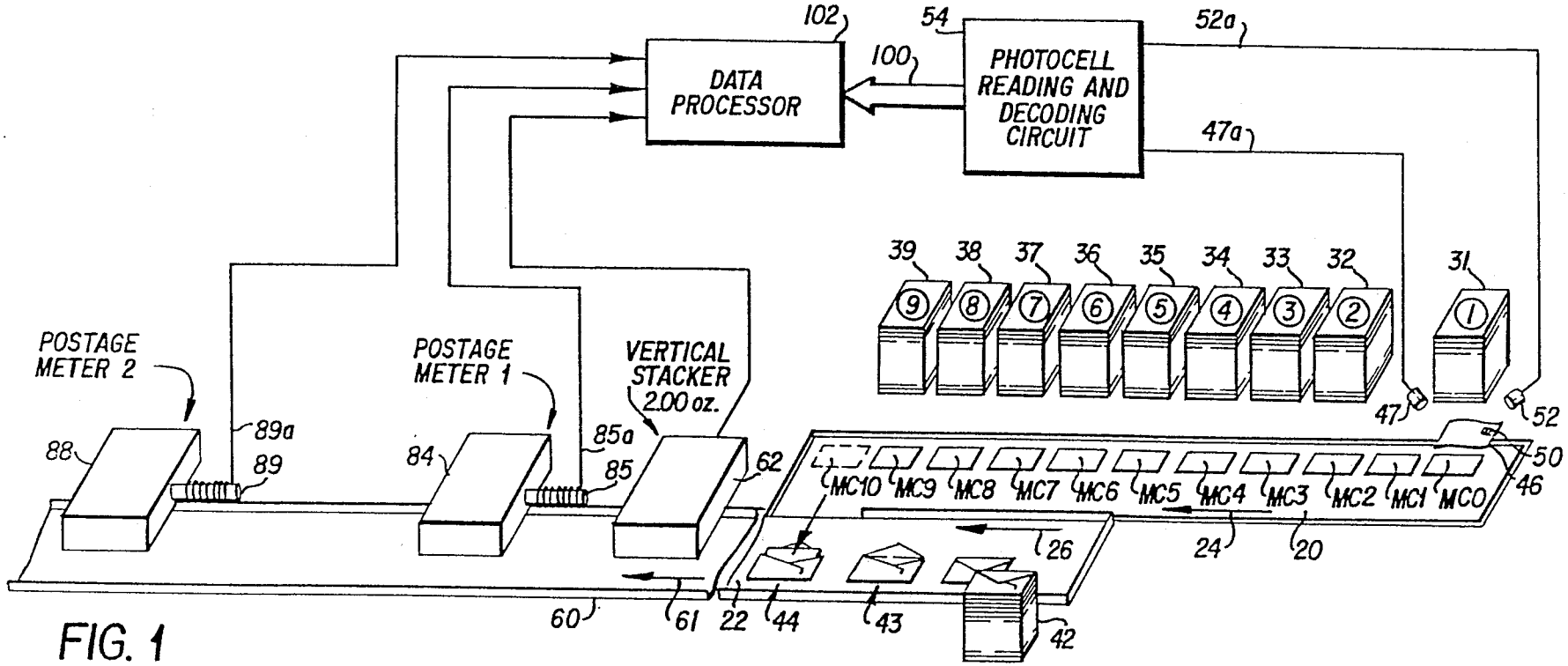
FIG. 1 is a schematic view of an insertion machine according to an embodiment of the invention.

FIG. 1 shows two parallel feed tracks or conveyors 20 and 22 which run parallel to one another in the direction of respective arrows 24 and 26. The first conveyor 20 travels past nine consecutive insertion stations 31, 32, 33, 34, 35, 36, 37, 38, and 39. In the embodiment shown, conveyors 20 and 22 are intermittently driven by a chain and sprocket arrangement so that the conveyors travel generally in the direction shown by the respective arrows 24 and 26. That is, during successive machine cycles a document on conveyor 20 travels in a leftward direction so that during the machine cycle MC2 the document is proximate the station 32; in the machine cycle MC3 the document is proximate the station 33, and so forth.

An envelope station 42 is positioned above and alongside conveyor 22 for discharging envelopes from a hopper of station 42 onto the conveyor 22. The conveyor 22 is indexed and station 42 is operated in timed relationship with the conveyor 20 so that, if a given customer's master control document is deposited onto conveyor 20 at MC0, that customer's envelope will be deposited onto conveyor 22 at about MC8. At MC9 the customer's envelope is opened at an envelope flap opening station generally pointed to by arrow 43. At MC10 the customer's documents, which have been cumulatively piled on top of one another as the documents travel down the conveyor 20, are stuffed into the opened envelope at a stuffing station (generally pointed to by arrow 44). While the structural and operational details of the envelope flap opening station and the envelope stuffing station are not specifically discussed herein, the same are understandable by the man skilled in the art, especially in view of the aforementioned Williams patent.

The first station (station 31) comprises a fast feeder for feeding one or more documents (also referred to as "sheets") per machine cycle onto the conveyor 20. A counter photocell 47 positioned proximate the first station 31 counts the number of documents fed from the fast feeder for each machine cycle. The documents fed by the feeder of station 31 during a given machine cycle are all associated with a particular customer. In the illustrated embodiment, the documents fed from station 31 are sheets included with a customer's bill or statement of account. In one mode (the "select" mode) the first document fed from station 30 with respect to each customer functions as a control document which to some extent governs downstream operations as seen hereinafter. In a simplified mode the document fed from station 30 does not govern downstream operations. FIG. 1 shows a control document 46 in the process of being fed from the sheet feeder (SF) station 31 and being deposited on conveyor 20 during the machine cycle MC0.

In the select mode the control document 46 bears an indicia in a field 50. The marks in field 50 comprise control and count indicia which are read in conventional manner by photocell reading means 52 positioned in proximity to station 30. Photocell reading means 52 is electrically connected by connector 52*a* to a photocell reading and decoding circuit 54. In the embodiment shown in FIG. 1, the photocell reading means 52 is operative with the circuit 54 to function as a conventional reflective-type reading system particularly adapted to read a bar code. The counter photocell 47 is electrically connected by connector 47*a* to the circuit 54. The circuit 54 is adapted to interpret the bar code in indicia field 50 and to interpret the number of documents counted by photocell 47, as well as to appropriately express and transmit the interpreted data via a data bus 100 to data processing means 102.

In the select mode the indicia field 50 borne by the master document 46 indicates from which of the subsequent stations documents are to be fed during a corresponding machine cycle (i.e. if appropriate inserts are to be selectively fed from the second insert station 32 during the machine cycle MC2, from the third insert station 33 during the machine cycle MC3, and so forth). Alternatively, in a simplified or automatic mode the insertion machine can be set up so that one insert is automatically fed from each insertion station for each customer.

Each of the stations 32–39 comprises suitable gripper means (not shown) for retrieving from the bottom of the stack in the hopper of the station during a corresponding machine cycle the one or more documents associated with a given customer. In this regard, the means for removing documents from the hopper of these stations is, in one embodiment, that disclosed in U.S. Patent 2,325,455 to Williams (incorporated herein by reference), although it should be understood that other types of means for extracting documents from these stations and for depositing the same on conveyor 20 may be employed.

The second document feeding station 32 comprises means for feeding one or more documents therefrom onto document 46 when document 46 is in a position on the conveyor 20 shown as MC2. In the embodiment shown in FIG. 1, the feeding means of station 32 feeds cards such as punched computer cards which the customer is required to return along with payment of his bill. It is to be noted that stations 31 and 32 are spaced apart by a segment of track 20 in which documents are positioned for machine cycle MC1.

In the embodiment illustrated in FIG. 1, insert stations 33, 34, and 35 contain general interest and/or special interest informational enclosures which the sender may wish to selectively include in the stuffed envelope containing the customer's bill. For example, station 33 may contain an enclosure which is to be sent only to customers whose bill is overdue; station 34 may contain an enclosure which may announce a future additional service to be provided by the sender; station 35 may contain an enclosure targeted to special customers such as the elderly, for example. In the select mode the indicia 50 on a customer's control document 46 indicates whether inserts are to be fed from one or more of the stations 33, 34, and 35 for the customer. In this respect, the indicia 50 on control document 46 requires that the inserts from these selected stations be included with the sheets comprising the customer's bill (fed from station 31) and the billing card (fed from station 32) in the customer's stuffed envelope. As seen hereinafter, the total weight of the envelope, billing sheets, billing card, and other required inserts is calculated so that a projected postage categorization range can be determined for the customer's envelope once it is stuffed.

In the example described above, the sender has not utilized insert stations 36, 37, 38, and 39 for his own purposes. Rather than let all these stations remain idle, the sender has placed advertising inserts for third parties in the stations 36, 37, 38, and 39. For example, in station 36 the sender has placed advertising inserts for a magazine publisher; in station 37 the sender has placed advertising inserts for a phonograph club promoter; in station 38 the sender has placed advertising inserts for an insurance company; and, in station 39 the sender has placed inserts for a travel agency.

For the example machine under discussion, stations 36, 37, and 38 have been designated as chargeback stations and station 39 has been designated as an optional insert station. For the chargeback stations, the third party advertisers associated with stations 36, 37, and 38 have requested that their third party advertisments be included in stuffed envelopes for each of the sender's customers, regardless of how inclusion might affect the postage amount for each customer. For the optional insert station (station 39), the sender has agreed to include an advertising insert in stuffed envelopes for each of the sender's customers if and only if, after inclusion of items from all chargeback stations, the additional weight of the optional advertising insert will not cause the customer's stuffed envelope to incur additional postage (i.e., inclusion of the optional insert will not cause the customer's stuffed envelope to jump into a higher, more expensive, postage categorization).

The sender determines the number of advertising inserts fed on behalf of each third party and charges each third party a per insert fee for the sender's service. In addition, as hereinafter described, the sender obtains renumeration from the third party advertisers for the additional postage necessitated by inclusion of third party advertising inserts from the chargeback stations 36, 37, and 38.

A downstream portion 60 of the conveyor generally travels in the direction of arrow 61 (which is essentially parallel to the direction of arrow 26). Although not specifically shown in FIG. 1, it should be understood that in accordance with differing embodiments numerous other stations are proximate the conveyor and upstream from portion 60 thereof. Examples of unillustrated intermediate stations include a sealing station (where a selectively operable sealing actuator seals envelopes), and one or more vertical stacking stations such as an error stacker station of a type which comprises stacking fingers to grasp documents and hold the grasped documents above the conveyor 20.

The downstream portion 60 of conveyor 20 comprises diversion means 62 which is selectively actuated by unillustrated actuation means 69. In the illustrated embodiment of FIG. 1 the diversion means 62 comprises a vertical stacker which includes fingers which, when actuated, lift an envelope from the plane of the conveyor 60 into a vertical hopper. Examples of diversion stackers are shown in U.S. Pat. No. 3,652,828 to Sather et al., which is incorporated herein by reference.

It should be understood, however, that in other embodiments other types of diversion means are employed. For example, in one embodiment the diversion means comprises a divert gate which, when actuated, deflects a travelling envelope onto a transversely-oriented conveyor. For purposes of the current illustration, stuffed envelopes weighing 2.00 ounces or more are classified as "overweight" and are diverted by diversion means 62.

A first postage meter 84 is positioned proximate the conveyor portion 60 ion essentially inline fashion for selectively applying an appropriate amount of postage to certain ones of stuffed envelopes travelling down the conveyor portion 60. In the illustrated embodiment, the first postage meter 84 is preset to apply appropriate postage to a stuffed envelope weighing in the range from 1.00 ounces to 1.99 ounces. The first postage meter 84 is activated by a solenoid 85 to apply postage to a stuffed envelope travelling proximate thereto on conveyor portion 60.

A second postage meter 88 is positioned proximate the conveyor portion 60, also in essentially in-line fashion but downstream from the first postage meter 84. Postage meter 88 selectively applies an appropriate amount of postage to certain others of stuffed envelopes travelling down the conveyor portion 60. In the illustrated embodiment, the second postage meter 88 is preset to apply postage to a stuffed envelope weighting in the range from 0.00 ounces to 0.99 ounce. The second postage meter 88 is activated by a solenoid 89 to apply postage to envelopes passing proximate thereby on conveyor portion 60.

From the foregoing it is seen that three weight classifications have been established with respect to the illustrated mode of FIG. 1; an overweight classification (2.00 ounces and greater); a top range classification (1.00 ounces to 1.99 ounces); and a low range classification (0.00 ounces to 0.99 ounces).

It is to be understood that further processing, such as zip code sorting, for example, takes place in unillustrated stations upstream from conveyor portion 60.

The insertion machine includes data processing means 102. In a first embodiment, the data processing means 102 is of the type described in United States Patent 4,639,873, INSERTION MACHINE WITH POSTAGE CATEGORIZATION AND SELECTIVE MERCHANDISING, which is incorporated herein by reference. However, rather than using hardware or mechanical counters to count the number of inserts pulled from the insert stations 36, 37, 38, and 39, the data processing means 102 of the present invention maintains counters for those stations in electronic memory in the manner hereinafter described.

Two other embodiments of the data processing means 102 are understood with reference to the data processing systems described in United States Patent 4,734,865, INSERTION MACHINE WITH AUDIT TRAIL AND COMMAND PROTOCOL, which is also incorporated herein by reference. The logic of the distributed chargeback feature, described hereinafter, is essentially the same for the data processing means of both of the incorporated patents, although naturally the respective instruction sets through which the logic is implemented differ for the differing microprocessors of the two patents.

Figure 2:
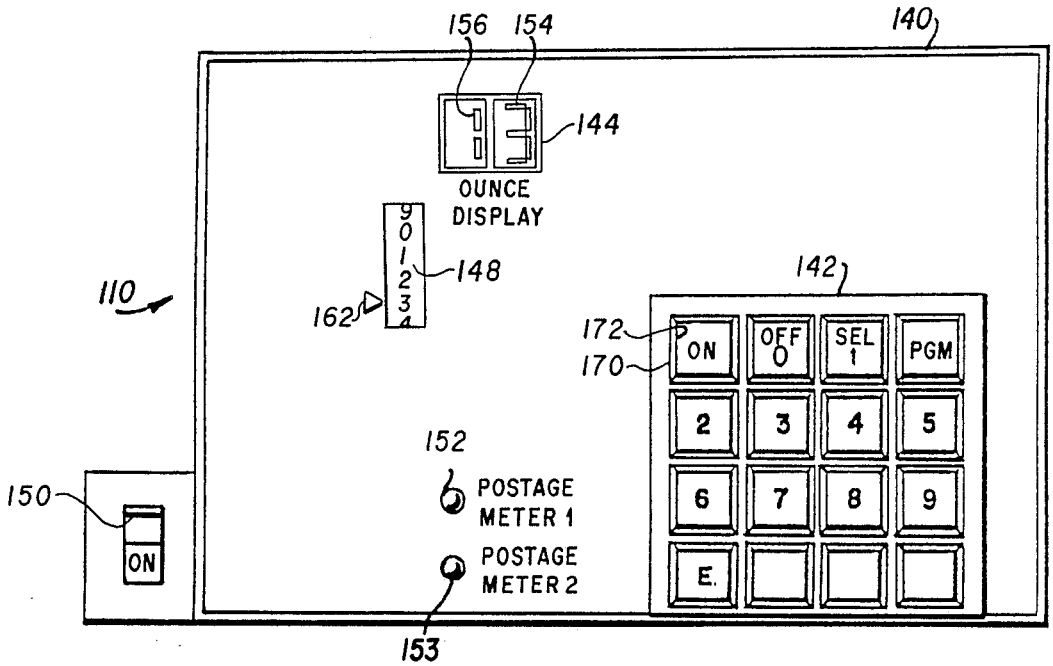
FIG. 2 is a front view of a keyboard and display panel of an insertion machine of a first embodiment of the invention.

This first embodiment data processing means 102 includes a keyboard and display 110 of the type illustrated in FIG. 2, as well as an encoder. The encoder is used to interface the data processor 102 to various elements, including the keyboard and display 110, the vertical stacker 62, and the solenoids associated with the postage meters 84 and 88. In this regard, the data processor 102 is connected by the respective electrical leads **85*a* and 89*a* to the solenoids 85 and 89 associated with the postage meters 84 and 88, respectively. The keyboard and display 110 comprises a display console or panel 140 which comprises a keyboard 142; an "ounce display" indicator 144; and, a thumbwheel dial 148. Shown proximate the display panel 140 in an "on" position is an ounce set-up mode switch 150** which is manually actuated to accomplish the purposes hereinafter stated.

Panel 140 also includes postage meter activation indicators such as LEDs 152 and 153. Indicator 152 is associated with a first postage meter (i.e. postage meter 84) while indicator 152 is associated with a second postage meter (i.e. postage meter 88).

Ounce display indicator 144 has a hundredths digit display 154 comprising a first seven-segment LED display and a tenths digit display 156 comprising a second seven-segment LED display.

The thumbwheel dial 148 is a conventional thumbwheel dial which, for the purposes of this invention, includes the numerals 0 through 9 on its outer circumferential rim. The selected thumbwheel setting is indicated by a selector mark 162 on the panel 140.

The keyboard 142 comprises four rows of keys 170, each row having four keys therein. The first or uppermost row of keys includes a "ON" key, an "OFF" key, a "SEL" or select key, and a "PGM" or program key. The "OFF" and "SEL" keys also double as keys for the numerals "0" and "1" respectively. Row 2 of the keyboard 142 includes separate keys for each of the four numerals "2", "3", "4", and "5". Row 3 if the keyboard 142 includes four keys for the numerals "6", "7", "8", and "9". Row 4, or the lowermost row of the keyboard 142 includes a key labeled "E". The keys are appropriately labeled in the just-described format, each key 170 bearing an appropriate indicia thereon. Each key 170 has a translucent central portion 172 which overlays a light source, such as an LED, associated with the key.

OPERATION: FIRST EMBODIMENT

It will be recalled that, in the first embodiment, the data processing means 102 of the invention resembles that described in United States Patent 4,639,873 as qualified above. The operation of the first embodiment will now be described in a mode which generally concerns the reading of a control document from the sheet feeder station 31 in order to determine the stations from which inserts are to be fed and the number of inserts fed from each. The operation of a simplified mode wherein insert stations automatically feed inserts without governance by read parameters is also understood from the ensuing discussion.

The data processing means 102 executes numerous specialized routines in connection with the overall operation of the entire insertion machine. These numerous routines are, for the most part, called into execution by master routines, including a master routine SYS. These lengthy and complex master routines supervise execution of the specialized routines, many of which are relatively independent rather than interdependent. In this respect, most of the specialized routines called by the master routines concern process steps which do not form a part of the present invention such as, for just one example, the operation and timing of means used to extract inserts from each of the insert stations along the conveyor. For this reason, only the specialized routines pertinent to this invention are discussed herein. The interface between the pertinent specialized routines and the appropriate master routine (SYS) is sufficiently discussed herein without describing all the collateral aspects of the master routine.

Figure 3:
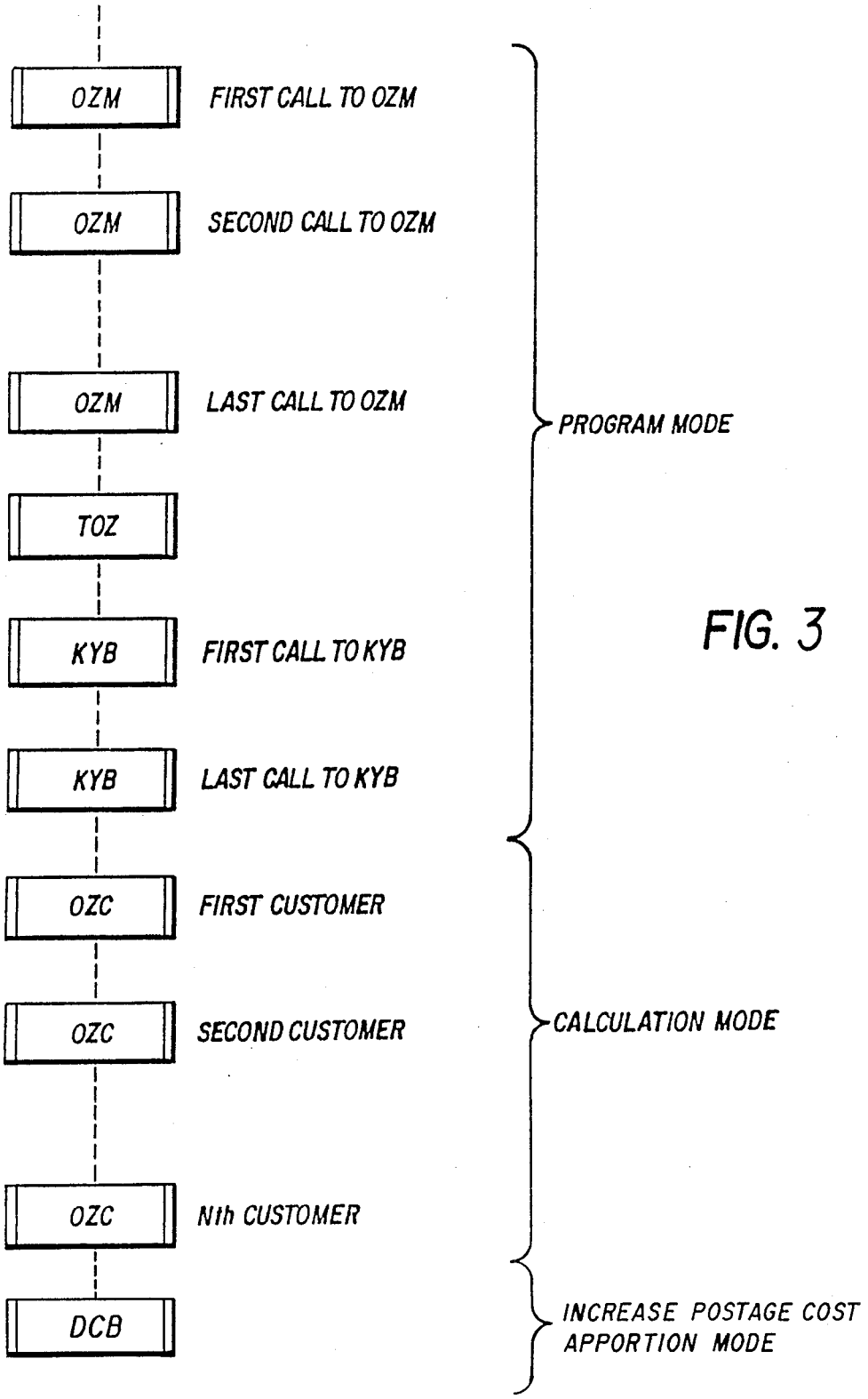
FIG. 3 is a schematic disgram depicting a sequence in which a master routine SYS, executed by a data processing means of a first embodiment of the invneiton, calls various specialized routines.

FIG. 3 illustrates the manner in which master routine SYS superintends processing of the various specialized routines which the data processing means 102 finds pertinent to the invention. It is to be understood that the specialized routines shown in FIG. 3 are included at intermediate processing sequence positions between start up and shut down of the insertion machine. The vertical arrangement of three dots between the routine blocks of FIG. 3 indicate that the specialized routines are not necessarily executed one after the other, but that calls to other specialized routines not pertinent to the invention may be interspersed in the sequence.

FIG. 3 shows that a program mode includes calls to routine OZM. The routine OZM, called when the PGM key on keyboard 142 is hit (PGM lamp lit) and switch 150 is turned "on", enables the operator to store in memory in the data processing means 102 data pertinent to the per item weight at selected insert stations and to display indications of the same on the panel 140. The routine OZM is called repeatedly until the switch 150 is manipulated to indicate that the set up mode is to be terminated (i.e. switch 150 is turned off) and the PGM key on keyboard 142 is pressed (PGM key lamp extinguished).

Sometime after the last call to routine OZM a call is made to the specialized routine TOZ. Routine TOZ basically transfers certain values at addresses in certain memory locations to other memory locations.

If the PGM key on keyboard 142 is again pressed (so that the PGM key lamp is lit) without the switch 150 having been turned on, calls are made to a routine KYB. Routine KYB enables the operator to manually enter on the keyboard 142 the desired status of each of the stations 32–39 and the envelope station 42. That is, for any station the operator can specify whether the station is to automatically feed inserts regardless of indicia markings, whether the station is to feed inserts depending on indicia markings, or whether the station is turned off so that no inserts are fed under any condition.

After execution of the program mode routines is completed, and when documents are properly positioned in the stations 31–39, the processing along track 20 can commence. Master routine SYS makes a call to routine OZC, the Ounce Calculation routine, for each customer after the customer's master control document 46 has been read. In conjunction with its various associated routines, the routine OZC computes the projected weight of the customer's stuffed envelope and determines how the stuffed envelope will be handled for postage purposes. In this latter regard, routine OZC in conjunction with routine OZS sets certain flags in memory depending on whether the stuffed envelope is overweight (hence to be diverted by stacker 62), is in the top postal-weight range (hence to be applied postage by meter 84), or is in the low-postal weight range (hence to be applied postage by meter 88).

Upon completion of the routine OZC for the last customer, the master routine SYS makes a call to the routine DCB. The routine DCB, which apportions certain postage cost among the third party advertisers having third party inserts at the chargeback insert stations 36, 37, and 38, is described below.

The details of the execution of routines OZM ("Ounce Set Up Mode"), TOZ ("Transfer Ounce"), KYB ("Keyboard"), OZC ("Ounce Calculation"), as well as details of the execution of various other routines called by these routines, are generally understood with reference to the incorporated United States Patent 4,639,873. However, the logic of the routine OZC of the current invention has been modified from the routine OZC described in United States Patent 4,639,873 in order reflect a different designation of insert stations (insert stations 36, 37, and 38 are chargeback stations and insert station 39 is an optional insert station) and to accommodate the distributed chargeback routine DCB. While United States Patent 4,639,873 discusses routine OZC at assembler level, for simplicity the current discussion of routine OZC is reformatted to a higher level logic and generalized for all embodiments of the data processor 102 of the present invention. Likewise the routine DCB is generalized in a manner suitable for all embodiments of the data processor 102 without constraint to particular instruction sets or programming languages.

OPERATION: SECOND AND THIRD EMBODIMENTS

It will be recalled that, in the second embodiment, the data processing means 102 of the invention resembles the data processing systems described in United States Patent 4,734,865. In these embodiments, the data processing means 102 is loaded with a customized software system comprising a plurality of concurrent programs. Various ones of the concurrent programs are associated with a particular type of processing station and include one or more concurrent tasks. The tasks comprising such programs are executable sets of instructions configured for performing various processing event-related functions.

A system global data bus SBUS is accessible by a plurality of concurrent programs. SBUS comprises a plurality of data records, each data record corresponding to one of a plurality of groups of documents being indexed along insert track 20 and having informational data elements relative to processing events performable with respect to that group of documents by various ones of the processing stations. By interfacing with SBUS the concurrent program associated with a particular processing station can, depending upon the nature of the characteristic processing event, perform logic required for the characteristic processing event either as early or as late as practical prior to the actual occurrence of the characteristic processing event.

As a customer's documents are discharged onto insert track 20 by the control station 31, a record of information is loaded into SBUS for that customer. The loaded information for the customer is conceptualized as corresponding to a column in SBUS. The loaded information is based at least partially upon indicia read with respect to that customer's documents, including read indicia indicative of which downstream insert stations are to feed if the respective stations are in a SELECT mode.

After a customer's documents are discharged onto insert track 20 and after a record corresponding to the customer has been loaded into an appropriate record position in SBUS, the concurrent program CW is signalled to begin execution of its CALCULATION mode for that customer. In particular, for the embodiment of FIG. 4, the CALCULATION mode portion of concurrent program is signalled for a customer at a relatively late point in the same machine cycle in which the customer's documents are discharged from control station 31 onto insert track 20. As a general rule the CALCULATION mode portion of the concurrent program CW is signalled for a customer at a late stage of the same machine cycle in which documents for that customer are fed onto the insert track 120 from the downstream-most reading insert station.

Figure 4A:
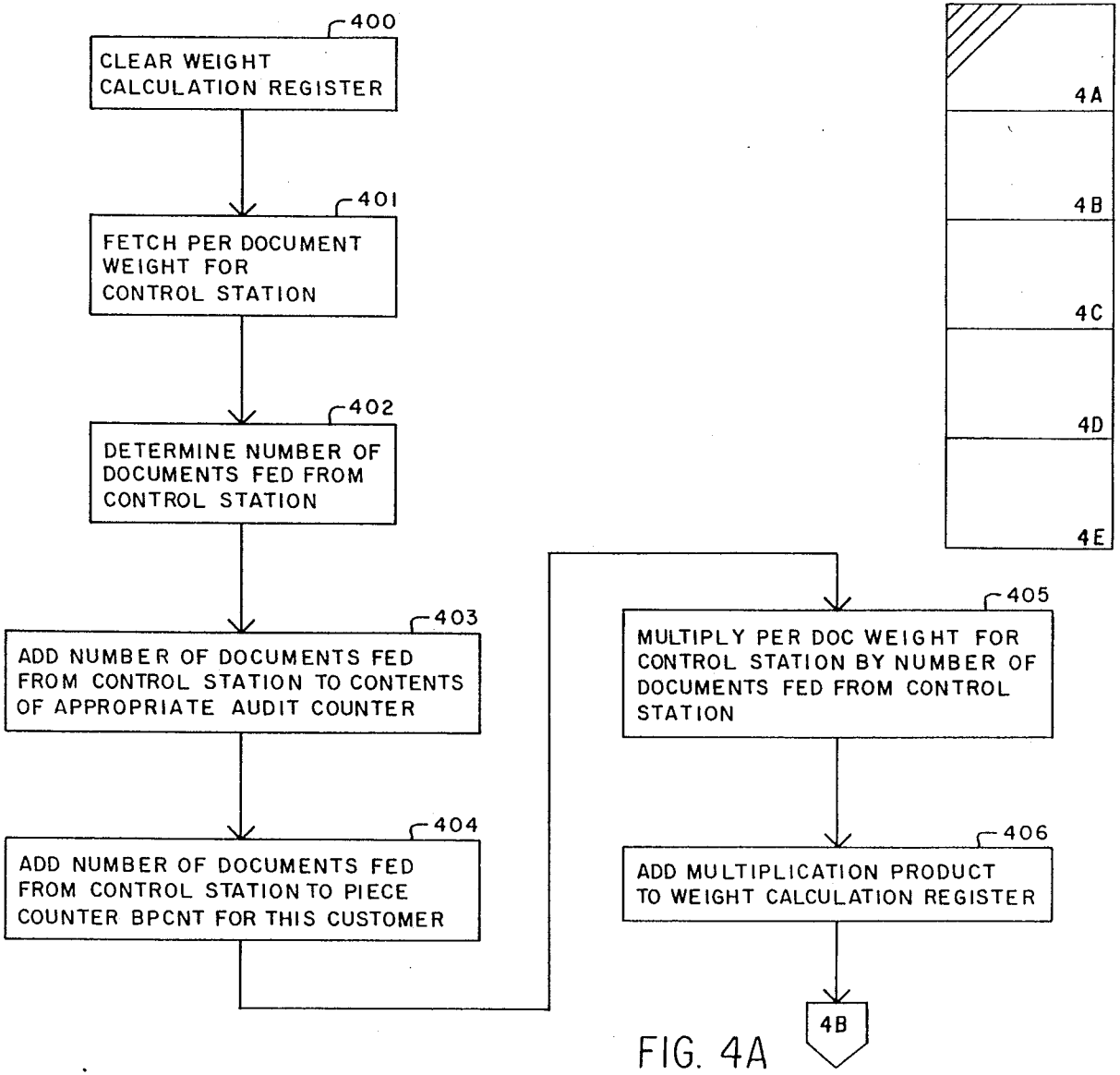
FIGS. 4A, 4B, 4C, 4D, and 4E are schematic diagrams illustrating processing operations involved in program CW.
Figure 4:
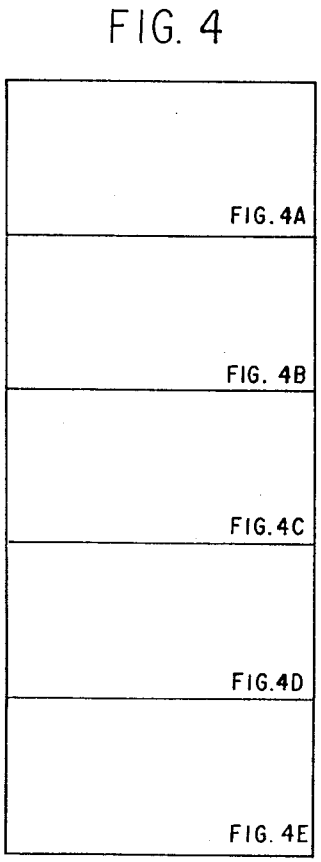
FIG. 4 is a schematic diagram showing the relationship of FIGS. 4A, 4B, 4C, 4D, and 4E.
Figure 4B:
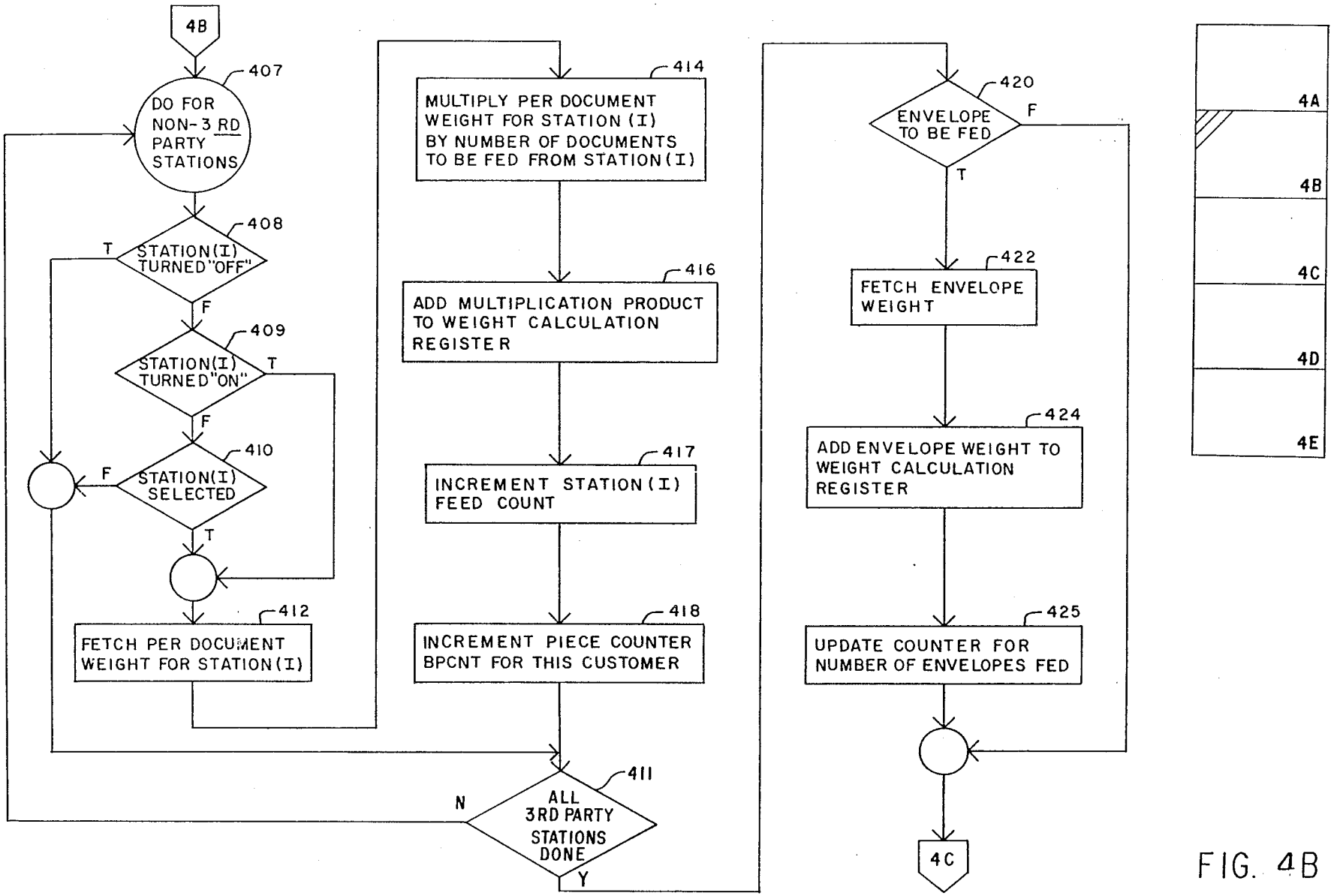

A portion of the processing conducted by the CALCULATION mode of concurrent program CW is shown in FIG. 4. In particular, the processing steps shown in FIG. 4 are executed for each customer at the appropriate time as described above. Processing begins for each customer by clearing a weight calculation register (step 400) which will be used to calculate a projected weight for the customer's stuffed envelope.

After the weight calculation register is clear, steps 401–406 are executed for a customer in connection with the control station 31. At sep 401 the concurrent program CW fetches the per document weight for the control station 31 from volatile RAM memory. At step 402 concurrent program CW determine's the number of documents fed for the customer from control station 31. In this respect, the number of documents fed for the customer is obatined from a global counter which is maintained by a concurrent task associated with the control station 31. The number of documents fed or the customer from the control station 31 is added at step 403 to an audit counter and at step 404 to a global piece counter BPCNT. Upon completion of concurrent program CW's CALCULATION mode for this customer the counter BPCNTY will be used as a tally for the number of inserts which will ultimately be included in the customer's stuffed envelope.

Knowing the number of documents fed for this customer from the control station 31 and the per document weight, at step 405 the concurrent program CW multiples these two factors to obtain the total weight of the sub-group of documents fed from the control station 31. At step 406 the multiplication product is added to the weight calculation register.

A loop commencing at symbol 407 of FIG. is executed a number of times corresponding to the number of non-third party advertising stations included in the insertion machine. In this regard, for the embodiment of FIG. 1 the loop commencing at symbol 407 is executed four times, each execution corresponding to one of the four insert stations 32 through 35.

During the loop which commences at symbol 407 a determination is first made (step 408) whether the station of interest for this execution of the loop (represented by the identifier STATION(1) in FIG. 4) was designated to be an "OFF" mode during the program mode of the current program CW. If the station is "OFF", the station cannot feed under any circumstance and thus the processing jumps to the end of the loop (represented by symbol 411). If the station is not in the "OFF" mode, a determination is then made (step 409) whether the station is in the "ON" mode and thus required to feed regardless of indicia. If a station is not determined to be in the "ON" mode at step 409, the station is in the "SELECT" mode and the particulate indicia read for this customer at the control station 31 becomes important. When a station is in the "SELECT" mode the concurrent program CW at step 410 accesses SBUS to determine whether or not the "select" bit corresponding to the station of interest for this execution of the loop has been set (indicating that this station is selected to feed). If the indicia indicates that the station has not been selected to feed, processing jumps to the end of the loop (represented by symbol 411).

Steps 412 through 416 are executed when the station of interset for this particular execution of loop 407 is either (1) in the "ON" mode, or (2) if the station is in the "SELECT" mode and the read indicia indicates that the station is to feed. In this regard, at step 412 the per document weight for the station is fetched from the appropriate memory location in which it was stored during the program mode of concurrent program CW. the per document weight for inserts at this station is so obtained, it is multiplied by the number of documents fed from the station (which in most cases will simply be one) (step 414). At step 416 the multiplication product is added to the weight calculation register to reflect the increase in the projected weight of the customer's stuffed envelope in anticipation of the station of interset for this execution of the loop feeding an insert document.

At step 417 a counter which counts the number of documents fed for the station of interest for this execution of the loop is incremented in accordance with the number of documents so fed. At step 418 a global piece counter BPCNT is incremented for this customer in accordance with the number of feeds from the station of interest and is used as a tally for the number of inserts which ultimately will be included in each customer's stuffed envelope.

Thus the loop bearing symbols 407 through 411 as shown in FIG. 4 is executed for each of the non-third party advertising stations (in the embodiment shown for stations 32, 33, 34, and 35). At the end of the last execution of this loop the weight calculation register will contain a value indicative of the sum of the weights of the documents expected to be fed from the control station 31 and from the non-third party advertising stations for this customer.

Steps 420, 422, and 424 as depicted in FIG. 4 involve the addition to the weight calculation register of a value representative of the weight of the envelope. In particular, at step 420 it is determined whether or not an envelope is to be fed for the customer. In this regard, if an envelope is to be fed, at step 422 the concurrent program CW fetches the envelope weight. The fetched envelope weight is ( at step 424) added to the weight calculation register. In addition, at step 425 the contents of a memory address is incremented to update the counting of the number of envelopes fed.

If an envelope is not to be fed for this customer, the steps 420, 422, and 424 are omitted for this customer, the processing continues at step 432 as discussed below.

Figure 4C:
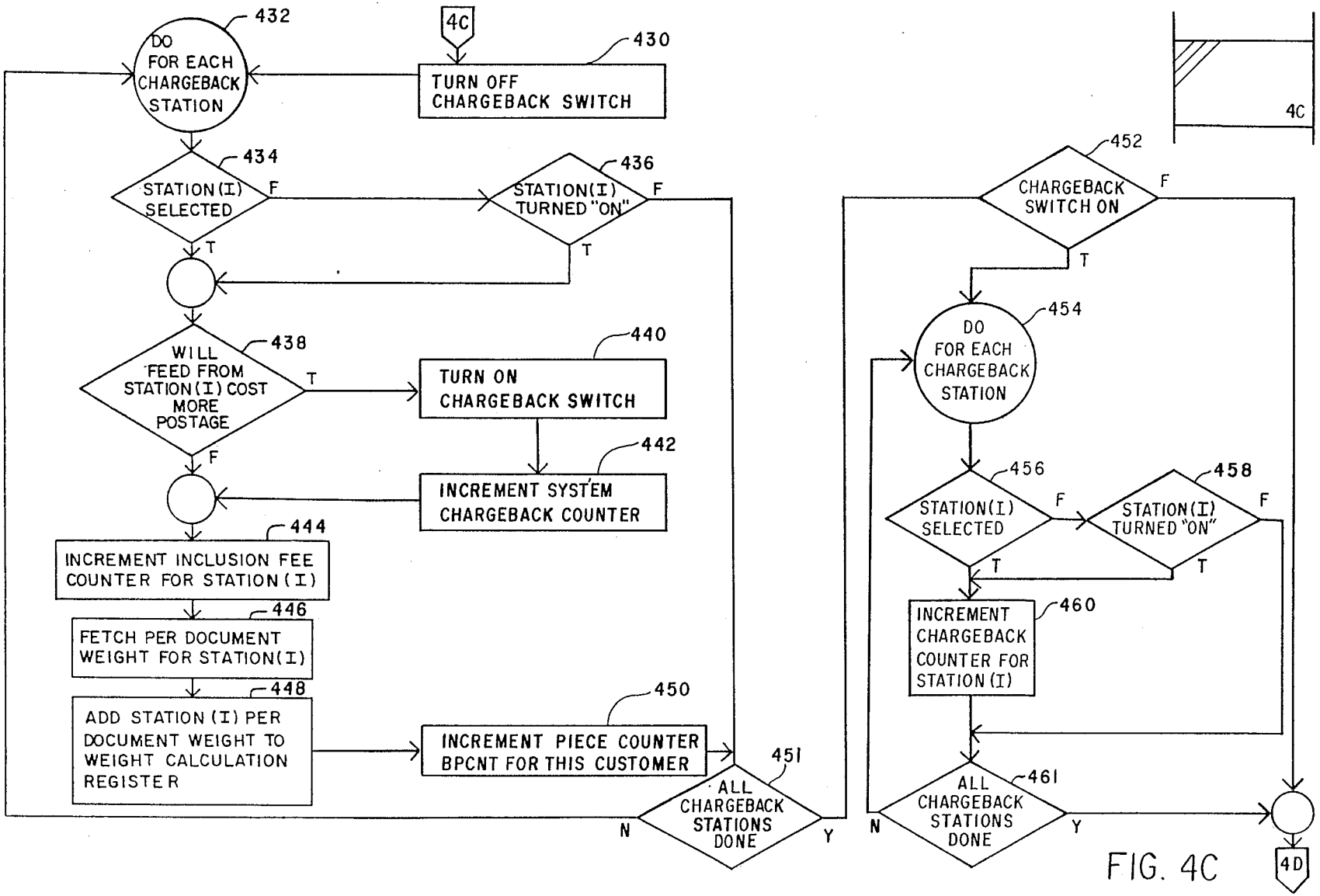
Figure 4D:
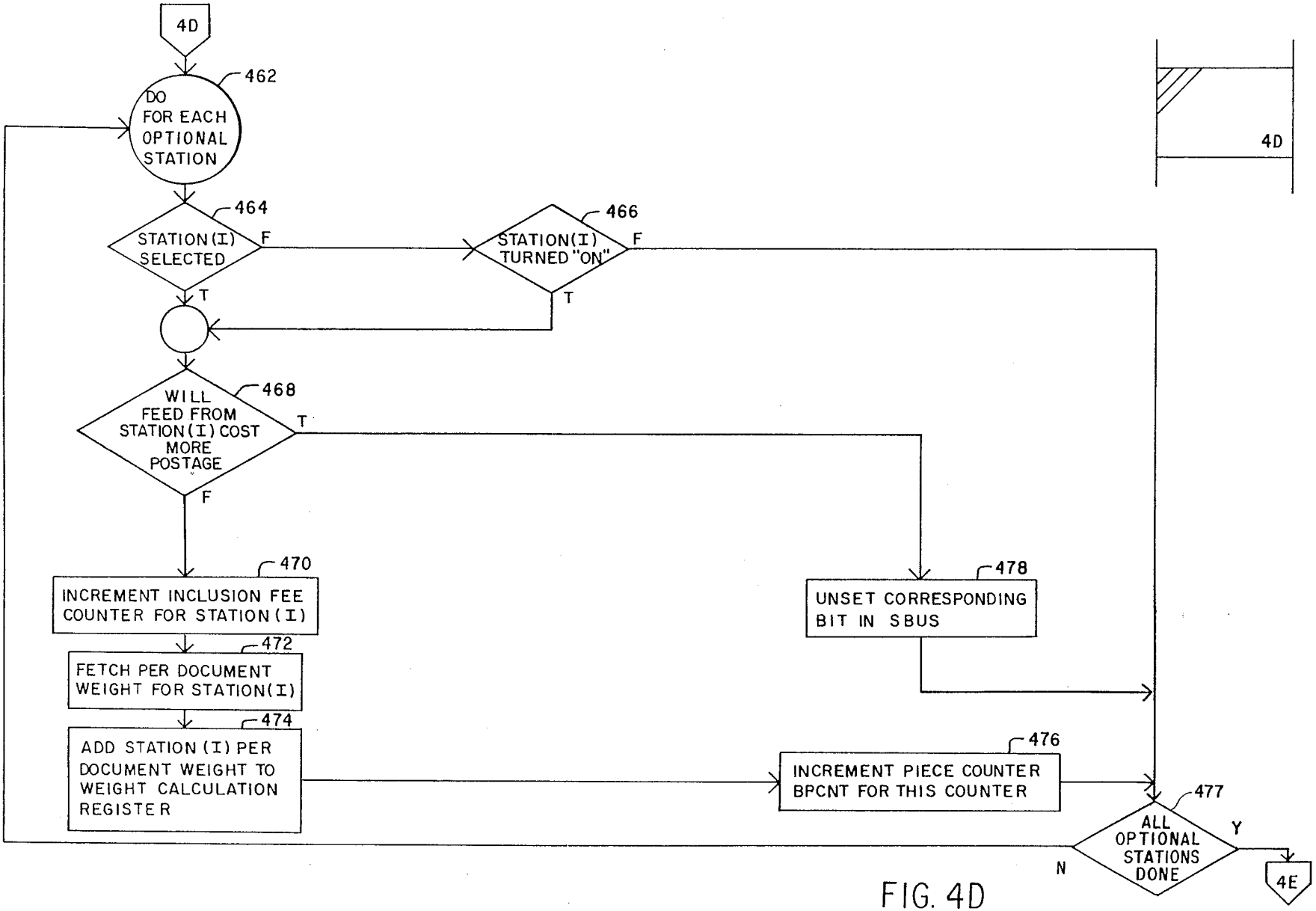

Thus far the weight calculation register includes a sum representing the weight of the envelope and the weight of inserts fed from the control station 31 and from the non-third party advertising insert stations 32, 33, 34, and 35. The processing of third party advertising insert stations is described hereinbelow with reference to FIGS. 4C and 4D. In particular, the processing of chargeback insert stations 36, 37, and 38 is described with reference to FIG. 4C; the processing of non-chargeback, or "optional", insert station 39 is described with reference to FIG. 4D.

Before discussing the processing of the third party advertising insert stations, it should be understood that the user can designate which insert stations are chargeback insert feed stations and which stations are optional insert stations. The user can enter his station designations into memory of the data processing system 102. Such entry can be accomplished through an operator panel, or through console and keyboard (both forms of designation entry being understood with reference to United States Patent 4,734,865). Alternatively, the insertion machine may be pre-configured so that certain stations are designated as chargeback stations and certain other stations are designated as optional insert stations, with the data processing system 102 being preprogrammed in accordance with the pre-configuration.

Before processing the chargeback insert stations, at step 430 the program CW turns off a switch CHARGEBACK. Then the program CW executes, for each chargeback station, a loop which commences at step 432.

In the loop commencing at step 432, the program CW first checks (at step 434) whether the chargeback station has been selected. Even if the chargeback station has not been selected, at step 436 the program CW checks whether the station has been turned "ON". If the station has not been selected and has not been turned on, the loop is completed for..that station., If, on the otherhand, the station has either been selected as determined at step 434 or turned on as determined at step 436, processing of the loop continues at step 438.

At step 438 a determination is made whether feeding from the chargeback station will push a customer's group of documents into a higher weight classification, with the result that additional postage cost will be incurred. If the determination at step 438 is positive, the program CW executes steps 440 and 422. If the determination at step 438 is negative, steps 440 and 442 are omitted and processing continues at step 444 as discussed below. At step 440, the switch CHARGEBACK is turned on to indicate that feeding from a chargeback station has resulted in additional postage costs for this customer. At step 442 a counter SYSTEM CHARGEBACK is incremented. As described hereinafter, the counter SYSTEM CHARGEBACK is later referenced to determined how many groups of documents were pushed into a higher postage category by feeding from one or more chargeback insert stations.

For all chargeback stations that are selected or on, the program CW increments an inclusion fee counter associated with each station (step 444). As described below, this inclusion fee counter is utilized to determine how many third party advertising inserts were actually fed from the associated chargeback insert station. The program CW then fetches the per document weight for the chargeback station (step 446), and then adds that weight to the weight calculation register (step 448). Thereafter, at step 450 the program CW increments a piece counter BPCNT for this customer.

After the program CW has completed execution of the loop commencing at step 432 for each chargeback station (at step 451, the program CW checks to determine if a second loop should be executed with respect to the chargeback stations. In this regard, should feeding from any one of the chargeback stations have resulted in increased postage for the group of interest, according to the present invention all the chargeback stations that contributed to the group should share in the increased postage amount, and that amount should be allocated among the third party advertisers associated with those feeding chargeback stations. To determine whether such a sharing should be implemented, the program CW checks at step 452 to determine whether the CHARGEBACK SWITCH is on. If the CHARGEBACK SWITCH is not on, steps 454, 456, 458, 460, and 461 are bypassed, and processing continues at step 462 as described further below. If the CHARGEBACK SWITCH is on, a second loop commencing at symbol 454 is executed with respect to each chargeback station. If the CHARGEBACK SWITCH is off, the program CW jumps directly to the processing of optional insert stations (as reflected in FIG. 4D).

If the CHARGEBACK SWITCH is on, the loop commencing at symbol 454 increments a CHARGEBACK COUNTER associated with each chargeback station that was either selected or "ON". In this respect, the program CW first checks at steps 456 and 458 whether a chargeback station is selected or ON, before incrementing the CHARGEBACK COUNTER at step 460. If either of the determinations at steps 456 and 458 are positive, then the CHARGEBACK COUNTER is incremented at step 460. If the determinations of steps 456 and 458 are both negative, then step 460 is bypassed and processing continues at step 461. At step 461 the program CW checks to make sure the loop has been executed for each chargeback station.

Having dealt with the chargeback stations, the program CW is now ready to handle the non-chargeback optional insert stations, i.e., those stations holding documents whose associated third party advertisers have directed that feeding occur only if a customer's group will not occur additional postage as a result of the feeding from the optional station. The processing of the optional insert stations is described with reference to FIG. 4D.

The processing of the optional insert stations is conducted by program CW in a loop which begins with symbol 462. In like manner as with the non-third party advertising stations and the chargeback stations, the program CW processes only those optional insert stations which are actually selected or ON. Checks for the selected and ON conditions are made at steps 464 and 466. This is done by accessing the appropriate bit in SBUS which corresponds to the station of interest for this execution of the loop. If an optional insert station is not selected or ON, the program CW jumps to the execution described below with reference to FIG. 4E.

Assuming that an optional insert station is either selected or ON, the program CW checks (at step 468) to determine whether the feeding of an optional third party insert from the station of interest for this execution of the loop would increase the weight of the customer's stuffed envelope sufficiently to require additional postage.

If it is determined at step 468 that an insert can be fed from the optional insert station of interest for this execution of the loop without increasing the weight of the customer's stuffed envelope to require greater postage, an inclusion fee counter for the station is incremented at step 470 to anticipate the permitted feed of the station and to provide a bookkeeping indication of the permitted feed so that the third party advertiser can appropriately be billed. If the feed from the station is permitted, the per document weight for documents fed from the station is fetched from the appropriate memory location (step 472) and the fetched weight for a document fed from this station is added to the weight calculation register (step 474). Moreover, at step 476 the piece counter BPCNT for this customer is incremented to reflect the inclusion of the document fed from this station of interest.

If it is determined at step 468 that the feeding of a third party advertising insert from the station of interest for this execution of the loop would result in additional postage for the customer, at step 478 a bit in SBUS corresponding to a feed directive for the station of interest for this execution of the loop is unset.

Thus, at the end of the last execution of the loop commencing at symbol 462, the weight calculation register for the customer contains the projected calculated weight of the envelope, the weight of the inserts added at the control station and the non-third party advertising stations; and, the weight of the inserts added at the third-party advertising stations (including both the chargeback stations 36, 37, 38 and the optional insert station 39). At step 477 a determination is made whether the loop commencing at symbol 462 has been executed for all optional stations.

After all executions of the loop commencing at symbOl 462, steps 480 and 482 are performed in order to load appropriate information into SBUS. In particular, at step 480 the value in location BPCNT reflecting the total number of inserts fed with respect to this customer is loaded in SBUS. An integer value related to the value contained in the weight calculation register for this customer (element BWGHT) is loaded into the customer's record in SBUS (step 482).

Figure 4E:
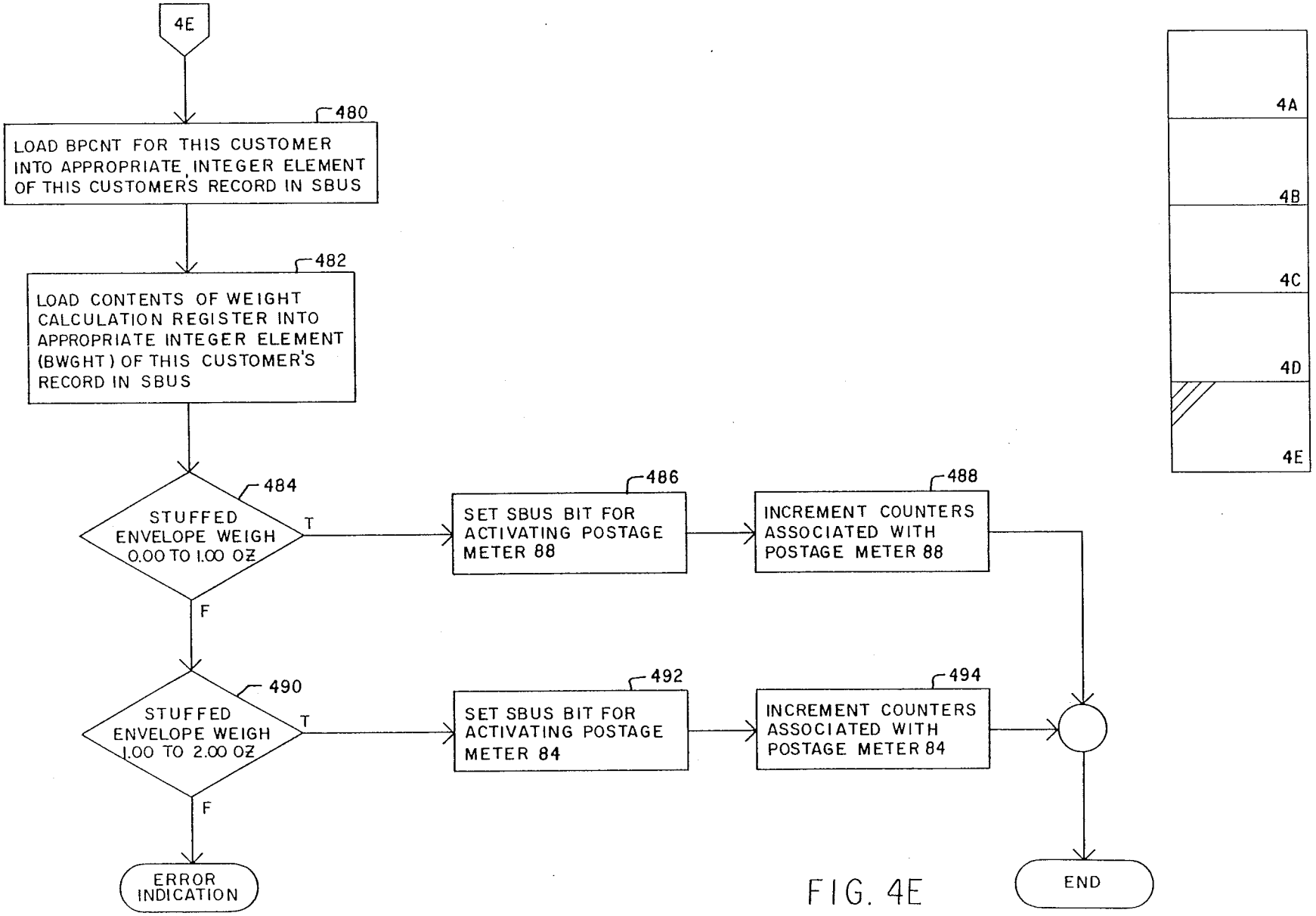

Various other steps shown in the portion of the CALCULATION mode of concurrent program CW illustrated in FIG. 4E concern the setting of postage meter bits in SBUS and the incrementation of counters associated with the postage meters (such as postage meters 84 and 88 of FIG. 1). In this regard, at step 484 it is determined whether the value in the weight calculation register for this customer qualifies for the 0 to 1.00 ounce postage weight classification. If the value in the weight calculation register so qualifies, an appropriate bit in SBUS corresponding to the postage meter 88 is set (step 486), assuming postage meter 88 to be preset to apply the correct amount of postage for this weight classification. Further, an audit counter indicative of the number of envelopes metered by the postage meter 88 is incremented (step 488). If the value in the weight calculation does not qualify the envelope for the 1 to 1.00 ounce postage weight classification, a check is made to determine (at step 490) whether the value in the weight calculation register corresponds to the 1.00+ to 2.00 ounce postage weight classification. If the determination is affirmative, the bit in SBUS corresponding to the postage meter 84 is set (step 492). Also, the audit counter for the number of envelopes and metered by the postage meter 84 is incremented (step 494), assuming the postage meter 84 to be preset to apply the correct postage for this classification range. If the determination at step 490 is negative, depending upon the embodiment utilized the operator is either apprised of an error or the stuffed envelope will eventually be diverted to the vertical stacker 62. As explained hereinbefore with reference to the calculation mode and as illustrated in FIG. 3, the steps of FIGS. 4A–4E (terminating at either step 488 or 494) are executed for each customer whose documents are included in a batch.

After a batch of groups has been run, the data processing system 102 calls a distributed chargeback program DCB. The distributed chargeback program DCB apportions, among the chargeback feed stations, the increases in postage cost occassioned by the feeding from chargeback feed stations for the batch. In this regard, if C represents the number of groups of items which, because of the feeding from one or more chargeback stations, were classified in higher postage categories, the cost A(X) apportioned to a chargeback feed station X is determined by program DCB by evaluating the following expression:

$$A(X) = \frac{D * C * (S(X) * W(X))}{(S(1) * W(1)) + (S(2) * W(2)) + \ldots + (S(N) * W(N))}$$

wherein

N represents the number of chargeback feed stations included in the machine;

S(X) represents the number of items fed from chargeback feed station X (X =1, 2, ... N);

W(X) represents the per item weight of items held at chargeback feed station X;

D represents the incremental cost occasioned by an increase from a lower to a higher postage classification.

It should be understood that the value C is obtained from the SYSTEM CHARGEBACK counter which was maintained by program CW at step 442; and that S(X) is the chargeback counter maintained for each chargeback station and incremented at step 460 of program CW. The value D is either user input or pre-programed into the data processing system 102. The entry of the Weight values W(X) is well understood with reference to the patents incorporated herein by reference.

Upon completion of the execution of the program DCB, an output indicative of the values A(X) for each of the chargeback stations 36, 37, and 38 is obtained via hardcopy (printer) or visual display (CRT) in accordance with output techniques well understood from the patents incorporated by reference herein.

Although the operation of the distributive chargeback feature of the invention has primarily been discussed with reference to the second embodiment of the data processing system, it should be well understood how the first embodiment data processing system is programmed to implement essentially the same logic as disclosed in FIGS. 4A–4E and the logic of the distributed chargeback program described above.

The embodiments of the invention in which an exclusive property or privilege is claimed are defined as follows:

We claim:

1. A machine of the type in which a plurality of feed stations feed items onto an insertion track for inclusion with an associated group of items, wherein the improvement comprises:

means for designating at least one of said feed stations as a primary feed station;

means for designating at least two of said feed stations as chargeback feed stations;

processing means including memory means and arithmetic logic means;

means including said processing arithmetic logic means for using values indicative of the per item weight of items held in said primary feed station and said chargeback feed stations to obtain a calculated total weight with respect to a group of items;

means for using said calculated total weight to determine a postage category in which said group of items is to be classified;

means for determining whether the feeding from at least one chargeback station requires that said group of items be classified in a higher postage category than than in which said group otherwise would have been classified; and means for apportioning, among the chargeback feed stations which fed items for inclusion with said group, the increase in postage cost occassioned by the classification of said group in said higher postage category.

2. The machine of claim 1, wherein said apportioning is in accordance with the relative per item weights of items held at said chargeback feed stations.

3. The machine of claim 2, wherein for a chargeback feed station said apportioned increase in postage cost for a group of items is related to a fraction, the numerator of the fraction being the per item weight of items held at said chargeback feed station and the denominator being the sum of the per item weights of items held at a plurality of chargeback feed stations.

4. The machine of claim 1, further comprising:

means for designating at least one of said feed stations as an optional feed station from which items may conditionally be fed;

means for determining whether optional items from at least one optional feed station can be fed and associated with said group of items without changing the postage category determined on the basis of the calculated total weight of said group of items; and, means for selectively enabling said optional feed station to feed items of inclusion with a group of items in accordance with said determination of whether said optional items can be fed without changing the postage category of said group of items.

5. The insertion machine of claim 4, further comprising:

means for determining which of said optional feed stations are to feed optional items to be associated with said group of items whereby the greatest number of optional items can be fed with respect to said group.

6. The machine of claim 4, further comprising:

counter means associated with at least one of said optional feed stations for providing an indication of the number of items fed from said optional feed station.

7. A method of operating a machine of the type in which a plurality of feed stations feed items onto an insertion track for inclusion with an associated group of items, wherein the improvement comprises:

designating at least one of said feed stations as a primary feed station;

designating at least two of said feed stations as chargeback feed stations;

using values indicative of the per item weight of items held in said primary feed station and said chargeback feed stations to obtain a calculated total weight with respect to a group of items;

using said calculated total weight to determine a postage category in which said group of items is to be classified;

determining whether the feeding from at least one chargeback station requires that said group of items be classified in a higher postage category than than in which said group otherwise would have been classified; and apportioning, among the chargeback feed stations which actually fed items for inclusion with said group, the increase in postage cost occassioned by the classification of said group in said higher postage category.

8. The method of claim 7, wherein said apportioning is in accordance with the relative per item weights of items held at said chargeback feed stations.

9. The method of claim 8, wherein for a chargeback feed station said apportioned increase in postage cost for a group of items is related to a fraction, the numerator of the fraction being the per item weight of items held at said chargeback feed station and the denominator being the sum of the per item weights of items held at a plurality of chargeback feed stations.

10. The method of claim 7, further comprising:

designating at least one of said feed stations as an optional feed station from which items may conditionaly be fed;

determining whether optional items from at least one optional feed station can be fed and associated with said group of items without changing the postage category determined on the basis of the calculated total weight of said group of items; and, selectively enabling said optional feed station to feed items for inclusion with a group of items in accordance with said determination of whether said optional items can be fed without changing the postage category of said group of items.

11. The method of claim 10, further comprising:

determining which of said optional feed stations are to feed optional items to be associated with said group of items whereby the greatest number of optional items can be fed with respect to said group.

12. The method of claim 10, further comprising:

providing an indication of the number of items fed from said optional feed station.

13. A machine of the type in which a plurality of feed stations feed items onto an insertion track for inclusion with an associated group of items, wherein the improvement comprises:

means for designating at least two of said feed stations as chargeback feed stations;

processing means including memory means and arithmetic logic means;

means including said processing arithmetic logic means for using values indicative of the per item weight of items held in said chargeback feed stations to obtain a calculated total weight with respect to a group of items;

means for using said calculated total weight to determine a postage category in which said group of items is to be classified;

means for determining the number of groups which, because of the feeding from at least one chargeback station, were classified in higher postage categories than those categories in which said groups otherwise would have been classified; and means for apportioning among the chargeback feed stations the increase in postage cost occassioned by the classification of said groups in said higher postage categories.

14. The machine of claim 13, wherein

N represents the number of chargeback feed stations included in the machine;

C represents the number of groups which, because of the feeding from at least one chargeback feed stations, were classified in higher postage categories than those categories in which said groups otherwise would have been classified;

S(X) represents the number of items fed from chargeback feed station X;

W(X) represents the per item weight of items held at chargeback feed station X;

D represents the incremental cost occasioned by an increase from a lower to a higher postage classification; and, A(X) represents the cost apportioned to chargeback feed station X with respect to C number of groups of items;

and wherein the value for A(X) is related to the following expression:

$$A(X) = \frac{D * C * (S(X) * W(X))}{(S(1) * W(1)) + (S(2) * W(2)) + \ldots + (S(N) * W(N))}$$

15. The machine of claim 13, further comprising:

means for designating at least one of said feed stations as an optional feed station from which items may conditionally be fed;

means for determining whether optional items from at least one optional feed station can be fed and associated with said group of items without changing the postage category determined on the basis of the calculated total weight of said group of items; and, means for selectively enabling said optional feed station to feed items for inclusion with a group of items in accordance with said determination of whether said optional items can be fed without changing the postage category of said group of items.

16. The machine of claim 15, further comprising:

means for determining which of said optional feed stations are to feed optional items to be associated with said group of items whereby the greatest number of optional items can be fed with respect to said group.

17. The machine of claim 15, further comprising:

counter means associated with at least one of said optional feed stations for providing an indication of the number of items fed from said optional feed station.

18. A method of operating a machine of the type in which a plurality of feed stations feed items onto an insertion track for inclusion with an associated group of items, wherein the improvement comprises:

designating at least two of said feed stations as chargeback feed stations;

using values indicative of the per item weight of items held in said chargeback feed stations to obtain a calculated total weight with respect to a group of items;

using said calculated total weight to determine a postage category in which said group of items is to be classified;

determining the number of groups which, because of r the feeding from at least one chargeback station, were classified in higher postage categories than those categories in which said groups otherwise would have been classified; and apportioning among the chargeback feed stations the increase in postage cost occassioned by the classification of said groups in said higher postage categories.

19. The method of claim 18, wherein

N represents the number of chargeback feed stations included in the machine;

C represents the number of groups which, because of the feeding from at least one chargeback feed stations, were classified in higher postage categories than those categories in which said groups otherwise would have been classified;

S(X) represents the number of items fed from chargeback feed station X;

W(X) represents the per item weight of items held at chargeback feed station X;

D represents the incremental cost occasioned by an increase from a lower to a higher postage classification; and, A(X) represents the cost apportioned to chargeback feed station X with respect to C number of groups of items;

and wherein the value for A(X) is related to the following expression:

$$A(X) = \frac{D * C * (S(X) * W(X))}{(S(1) * W(1)) + (S(2) * W(2)) + \ldots + (S(N) * W(N))}$$

20. The method of claim 18, further comprising:

designating at least one of said feed stations as an optional feed station from which items may conditionally be fed;

determining whether optional items from at least one optional feed station can be fed and associated with said group of items without changing the postage category determined on the basis of the calculated total weight of said group of items; and, selectively enabling said optional feed station to feed items for inclusion with a group of items in accordance with said determination of whether said optional items can be fed without changing the postage category of said group of items.

21. The method of claim 20, further comprising:

determining which of said optional feed stations are to feed optional items to be associated with said group of items whereby the greatest number of optional items can be fed with respect to said group.

22. The method of claim 20, further comprising:

providing an indication of the number of items fed from said optional feed station.

* * * * *